United States Patent [19]

Dorr

[11] Patent Number: 4,572,679

[45] Date of Patent: Feb. 25, 1986

[54] SLAVED RAMP VOLTAGE GENERATOR FOR A CALLIGRAPHIC CHARACTER PRINTER

[75] Inventor: Steve Dorr, Windham, N.H.

[73] Assignee: Centronics Data Computer Corp., Hudson, N.H.

[21] Appl. No.: 242,660

[22] Filed: Mar. 11, 1981

[51] Int. Cl.[4] ..... B41J 3/04

[52] U.S. Cl. ..... 400/17; 400/18; 400/19; 400/322

[58] Field of Search ..... 400/17, 18, 19, 322, 400/323, 903

[56] References Cited

U.S. PATENT DOCUMENTS

| | | | |
|---|---|---|---|
| 3,950,685 | 4/1976 | Kramer | 400/280 X |
| 4,044,881 | 8/1977 | Chai et al. | 400/322 X |
| 4,150,902 | 4/1979 | Brescia | 400/18 X |
| 4,203,678 | 5/1980 | Nordstrom | 400/322 X |

*Primary Examiner*—Paul T. Sewell

*Attorney, Agent, or Firm*—Henry D. Pahl, Jr.

[57] ABSTRACT

The slaved ramp voltage generator disclosed herein facilitates the writing of characters by a servo controlled stylus carried on a moving carriage. The carriage is driven at a selectable speed and the drive system generates pulse signals at a rate which is proportional to carriage speed. A digital counter is advanced by these pulse signals and the digital value held by the counter is converted to an analog voltage which varies in proportion to displacement of the carriage. This carriage displacement voltage is summed with a vector-defining position voltage to obtain a control voltage which drives the stylus servo mechanism to effect writing with respect to a moving frame of reference.

5 Claims, 3 Drawing Figures

SLAVED RAMP VOLTAGE GENERATOR FOR A CALLIGRAPHIC CHARACTER PRINTER

BACKGROUND OF THE INVENTION

The present invention relates to a calligraphic character printer and more particularly to a method and apparatus for generating a compensating voltage useful in performing writing from a moving carriage.

Calligraphic character writing systems are known in which a pen or stylus, together with driving servo mechanisms, are transported on a carriage from character position to character position. As each position is traversed, the servo mechanisms are energized to effect tracing out of the desired character. In the copending and coassigned application of Richard M. Ulvila entitled High Speed Character Writer, a system for writing from a moving carriage is disclosed and generically claimed. The present invention pertains to an improved and presently preferred implementation of the general scheme claimed in that copending application.

As is understood, the vectors or line segments which make up a character will typically be stored in digital form in digital memory devices. So-called read only memories are usually preferred, packaged in a form which permits them to be easily exchanged, e.g. to effect the changing of character fonts. In the prior art character writing or printer system as disclosed, however, it appears that the carriage is moved from one position to the next and stopped to allow writing of each character. This then permits the vectors which typically make up each character to be defined with respect to a fixed frame of reference. While the possibility of writing while the carriage is moving has been suggested e.g. in the Brescia patent, no structure implementing this function is disclosed. Clearly, writing from a moving carriage has a substantial advantage in total throughput of the machine since the time spent accelerating and decelerating the carriage is deducted from the time available for writing. This loss of time sets an upper limit on the overall speed of the device which limits throughput no matter what improvements are made in the speed of the servomechanisms which drive the pen and stylus. As will be understood by those skilled in the art, the coding of vectors in digital form could be implemented so that the vector orientations themselves take into account the moving frame of reference. In this way the character resulting from writing from a moving carriage would have the desired shape notwithstanding the moving frame of reference. However, as will also be appreciated by those skilled in the art, such a compensation would be fixed in the original coding of each character and would be valid for a single carriage speed only.

Among the several objects of the present invention may be noted the provision of a high speed calligraphic character writer; the provision of such a character writer in which writing is effected from a carriage while the carriage is in motion; the provision of such a writer in which writing is performed by a stylus driven in transverse directions by a pair of servomotors carried on a carriage which is moving at a freely selectable velocity; the provision of such a system which is highly reliable and which is of relatively simple and inexpensive construction. Other objects and features will be in part apparent and in part pointed out hereinafter.

SUMMARY OF THE INVENTION

Briefly, the present invention pertains to a calligraphic character printer of the type in which a carriage transports a pair of stylus-controlling transducers along a line of print. Means are provided for driving the carriage at a selectable speed and for synchronously generating pulse signals at a rate which is proportional to the carriage speed. A digital counter is advanced by the pulse signals and the value held by the counter is converted to provide an analog voltage which varies in proportion to displacement of the carriage. A pair of voltages which represent stylus velocity components along transverse directions relative to a fixed frame of reference are generated from stored data. These voltages are integrated to generate respective relative position voltages. The carriage displacement voltage is summed with at least one of the relative position voltages, thereby to obtain respective control voltages for the transducers.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
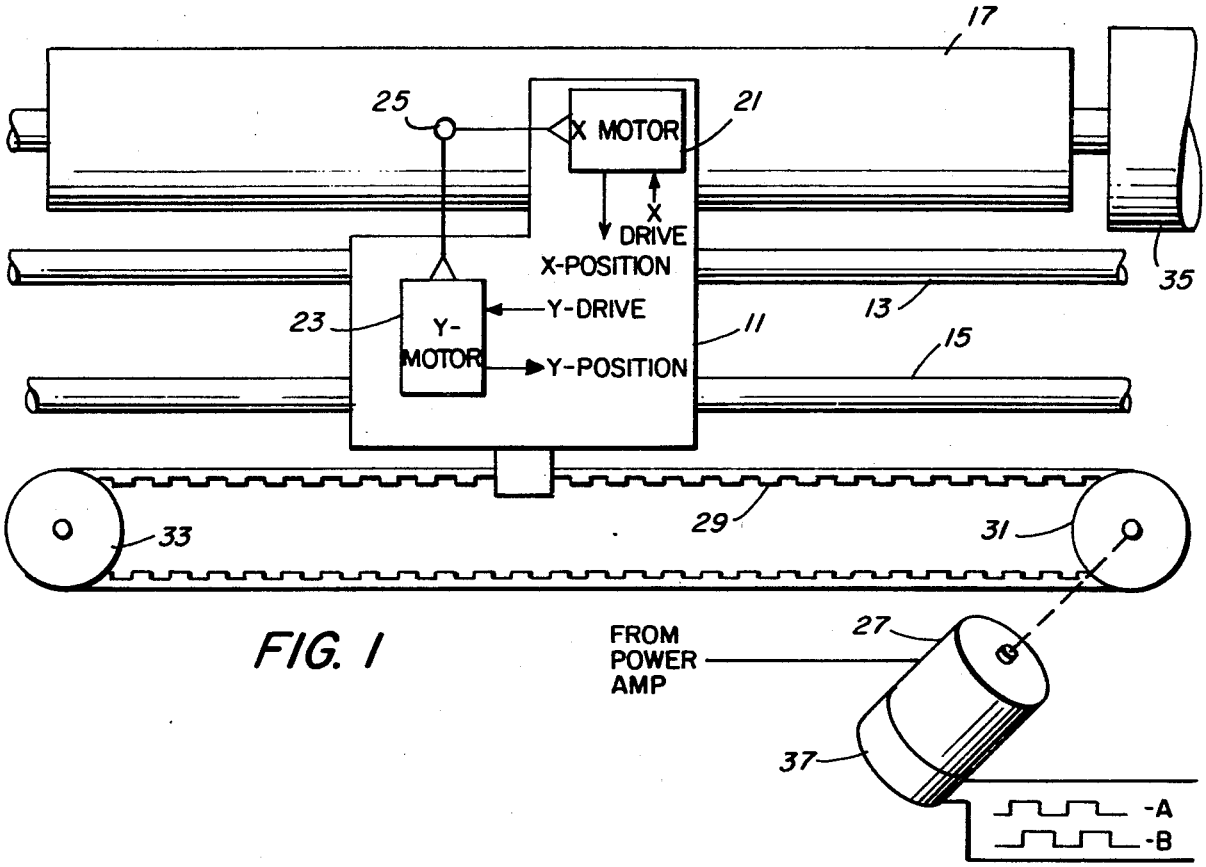
FIG. 1 is a diagram of a calligraphic writing mechanism used in the present invention.

Referring now to FIG. 1, a carriage mechanism is indicated generally by reference character 11. Carriage 11 is slideably mounted on a pair of rails 13 and 15 so as to be moveable along a platen, indicated generally by reference character 17. Platen 17 may, for example, be of the character of a typewriter roller through a fixed platen, independent of the paper feed mechanism, could also be used.

Carriage 11 carries a pair of linear transducers or servomotors 21 and 23 which are adapted for moving or positioning a pen or stylus 25. The servomotors are oriented for moving the stylus 25 along essentially transverse axes. The servomotor 21 moves the stylus along an axis parallel to the carriage motion (the X-axis) while the servomotor 23 moves the stylus along the transverse or vertical axis (the Y-axis). Each of the linear transducers 21 and 23 is responsive to a control signal for moving the stylus along the respective transverse axis and includes also means for generating a feedback or position signal. In the presently preferred embodiment, optical feedback transducers are employed, similar to those described in the Brescia patent identified earlier. Carriage 11 will typically also include a third drive mechanism (not shown) for loading and unloading the stylus to effect writing or not and to vary the loading on the stylus.

At the outset, it may be noted that writing is effected by moving the carriage along the platen 17 from character position to character position and writing in each character position by energizing the linear servomechanisms 21 and 23 to move the stylus 25 along in accordance with a set of vectors defining the character. The definition of these vectors is preferably stored in digital form in a suitable digital memory, e.g. a so-called read only memory, which may be readily interchanged to effect changing from one font to another. The stylus 25 may be in the form of a pen to effect direct writing or, preferably, will press through a carbon film ribbon to effect writing on paper supported by platen 17.

Carriage 11 is moved along the length of platen 17 by a d.c. servomotor 27 which drives a timing belt 29 passing over a pair of rollers 31 and 33. This is the means for providing movement along a row of characters, i.e. in the horizontal direction. Movement of the paper in the transverse direction, e.g. vertical, is provided by means of a stepping motor 35 which rotates the roller platen 17.

In order to provide a feedback mechanism for sensing movement of the carriage and for keeping track of its position, the servomotor 27 is provided with a shaft encoder 37. Encoder 37 is of the type providing square-wave signals in phase quadrature, as indicated at A and B, so that both motor speed and direction of rotation can be determined. Other types of encoders might also be used. The positional information signals A and B are provided to the overall control processor of FIG. 3 as control signals as well as to the servo control circuitry of FIG. 2.

Figure 3:
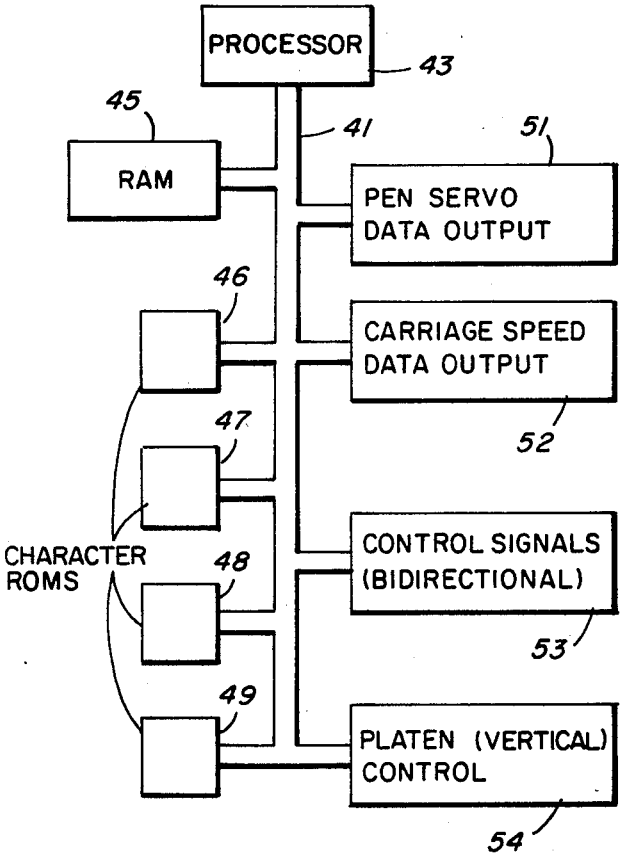
FIG. 3 is a block diagram of a generalized microcomputer system appropriate for providing data to the circuitry of FIG. 2 and for generally supervising operation of the apparatus.

As indicated previously, the definitions of the vectors which make up each character are preferably stored in digital form in a read only memory and are then utilized by a microprocessor controller to generate the actual data which controls the stylus-driving servomechanisms and the carriage drive. The general organization of this microprocessor system is illustrated in FIG. 3. The system illustrated in bus-oriented, that is, memory devices, I/O ports, and the processor are all connected to a common data and control bus. This bus is indicated generally by reference character 41, the processor itself being indicated at 43. In one embodiment of the invention, processor 43 was an Intel 8085 microprocessor and the memory and I/O components were implemented using integrated circuits from the same family of devices. As is understood, the advantage of using a microprocessor-driven controller is that the mode of operation may be flexibly changed under software control, without extensive hardware redesign. In implementing its control function, the processor utilizes random access memory for storing operating parameters, such memory being indicated by reference character 45. Fixed data, i.e. data defining the vectors which make up each character in a font, is stored in so-called read only memory, such memories being indicated in FIG. 3 at reference characters 46–49.

Figure 2:
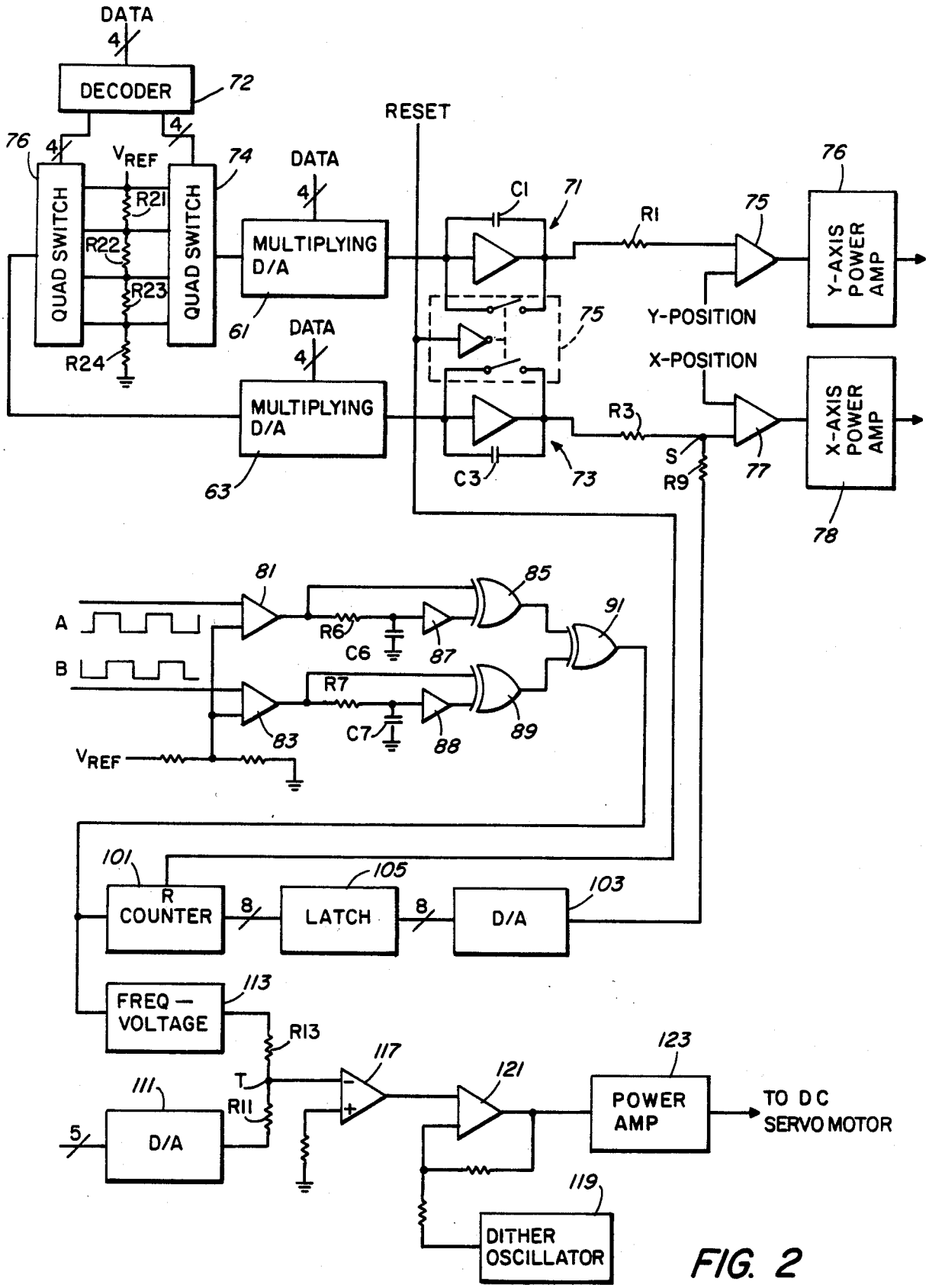
FIG. 2 is a schematic diagram of control circuitry employed in operating the mechanism of FIG. 1 in accordance with the present invention.

Digital data for defining the operation of the control circuitry of FIG. 2 is provided from the microprocessor system through latched output ports 51 and 52. Port 51 provides data for the pen servos while the port 52 provides carriage speed information. As is common to such systems, various control signals are needed by the processor to determine the state of the mechanism and various control signals are provided out to the mechanism controllers. A bi-directional port for this purpose is indicated by reference character 53. A third I/O port 54 is provided for vertical control, i.e. the controller which drives the stepping motor 35. However, this mechanism forms no part of the present invention and is not disclosed in detail herein.

Preferably, the vector defining data is stored in terms of direction and length of vector. Among the functions performed by the microprocessor system of FIG. 3 is to expand the data and generate respective X- and Y-axis components. These values are specified to four bits of accuracy each and are applied, respectively, to the digital to analog converters (DACs) 61 and 63 of FIG. 2. The values provided to the control circuitry represent velocity components. To get displacement values, the voltages obtained from the DACs 61 and 63 are integrated by the circuits indicated at 71 and 73, respectively. Each of these circuits comprises an inverting amplifier and an integrating capacitor, C1 and C3, respectively. The capacitors C1 and C3 can be discharged, i.e. to reset the integrators, by means of respective analog switches. The dual analog switch which performs this function, together with its control circuitry, is as indicted generally by reference character 75. The resetting switch circuitry 75 is operated by a control signal, designated RESET, which is one of the signals obtained from the control port 53 of the microprocessor controller of FIG. 3.

The output signals from the integrators 71 and 73 are applied, through respective current-limiting resistors R1 and R3, to error amplifiers 75 and 77. The error amplifiers 75 and 77 are responsive to the difference between the integrator output signals and the respective position signals obtained from the X and Y linear servomechanisms 21 and 23. The error amplifiers, in turn, drive, in conventional fashion, X- and Y-axis power amplifiers 76 and 78.

The quadrature output signals obtained from the shaft encoder 37 are each applied to one input of a respective comparator 81 and 83. A suitable intermediate reference voltage is applied to the other input of each comparator. The output from comparator 81 is applied directly as one input to an exclusive OR gate 85 and, in delayed form, as the other input to gate 85. The delay is effected by a filter comprising a resistor R6 and capacitor C6, with squaring up being performed by a buffer gate 87. The function of this delay and gating circuitry is to provide, at the output of gate 85, a brief pulse for each transition, positive or negative, in the input signal A. A completely similar circuit provides, in response to the input signal B, a corresponding pulse train at the output of an exclusive OR gate 89. The pulse trains obtained from the gates 85 and 89 are combined in an exclusive OR gate 91. The output of this gate comprises a pulse for each transition in either of the input signals (A or B). In effect, a factor of four multiplication in the pulse rate is provided as compared with the pulse rate of either one of the input signals. If the carriage were driven by a stepper motor instead of the d.c. servomotor 27, the pulse signal used to advance that motor might be used in place of the pulse train generated by the shaft encoder 37.

The pulse train obtained from the gate 91 is applied to a counter 101 so that the counter generates a digital value which varies in proportion to displacement of the carriage. This counter 101 is reset along with the resetting of the integrators 71 and 73 at the start of each character. Thus, the digital value held by the counter in one sense represents displacement across the character position. The digital value in counter 101 is converted to an analog signal voltage by a digital to analog (D/A) converter 103, the transfer being buffered by a latch 105 which is loaded in synchronism with the counting to minimize ripple-through effects. In one sense, the output voltage from the D/A converter 103 comprises a ramp as the carriage moves across the platen. This ramp voltage, however, is not a time dependent function in the usual sense, but rather is proportional to actual displacement of the carriage and thus, in the time domain, will vary as the speed of the carriage varies.

The ramp voltage obtained from D/A converter 103 is mixed in or summed with the X axis position signal obtained from the integrator 73, the ramp signal being applied, through a resistor R9, to a summing junction S at the input of error amplifier 77. The addition of this carriage displacement component into the vector-defining voltage allows the writing of characters from the moving carriage without requiring alteration of the basic vector encoding scheme and, in a manner, allowing the velocity of the carriage to change. Because of this compensation, the carriage can be driven relatively rapidly when simple characters are being written and more slowly for more complex characters. In this way, the throughput of the machine can be substantially increased as compared with the situation which would exist if the speed of the carriage had to be kept constant, as would be the case if compensation were built into the vector encoding scheme. In such a case the single speed chosen would have to be relatively low, i.e. selected to permit forming of the most complex character to be written.

Selection of carriage speed is performed by the microprocessor system of FIG. 3, a data word representing the desired carriage speed being output through the port 52. This data, at five bits of accuracy, is applied to a digital-to-analog converter 111. The output signal from converter 111, which is an analog voltage representing desired speed, is compared with a voltage representing actual speed. This latter voltage is obtained by a frequency-to-voltage converter 113 driven by the pulse train from gate 91. As described previously, the pulse in this train is generated at a rate which is proportional to the speed of the carriage, being derived from the shaft encoder associated with the carriage drive motor 27. The output voltages from the frequency-to-voltage converter 113 and the D/A converter 111 are applied, through respective mixing resistors R11 and R13, to a summing junction T to derive an error signal. This error is amplified as indicated at 117. The amplified error signal is mixed with an a.c. component obtained from a dither oscillator 119 at the input of an amplifier 121 which, in turn, drives a power amplifier controlling the servomotor 27.

The embodiments illustrated includes provision for forming characters of different sizes from the same font data, i.e. the digital data being applied directly to the digital-to-analog converters 61 and 63. For this purpose, the converters are of the so-called multiplying type in which the output voltage is proportional, not only to the digital value applied, but also to an analog reference voltage. A four bit data word, again obtained from the microprocessor controller of FIG. 3, is applied to a decoder 72 which generates two separate one-of-four selection signals. Each of these set of signals is applied to a respective quad switch 74 and 76 to select one of four predetermined voltages for application, as a reference voltage, to the respective digital analog converter 61 or 63. The predetermined voltages are obtained from a voltage divider comprising resistors R21–R24. The resistors R21–R24 are selected to produce voltages corresponding to desired typesizes rather than to perform a normal digital-to-analog conversion. The nature of the decoding is such that only one switch in each of the packages is on at any one time so that the reference voltage applied to each digital-to-analog converter 61 or 63 may be independently selected. Accordingly, since the horizontal and vertical scaling factors can be selected separately, characters of different aspect ratios can be formed from the same data as well as merely scaling the characters.

In the embodiment illustrated, the axis of one of the linear servotransducers driving the stylus is parallel to the direction of carriage movement and the other axis is essentially perpendicular thereto. Accordingly, the displacement based compensation signal only needs to be mixed with one of the two control signals driving the servotransducers in order to obtain the desired moving frame of reference. On the other hand, those skilled in the art will appreciate that an arrangement could be utilized in which the axes of both linear servotransducers were at an angle, e.g. 45° to the direction of carriage movement, though perpendicular to each other. In such a case, displacement compensation components of appropriate magnitude would be summed with each of the servocontrol signals, observing appropriate polarity. Such an arrangement should be understood to be within the scope of the present invention.

Summarizing, it can be seen that the present invention facilitates the digital encoding of character defining vectors with respect to a seemingly fixed frame of reference. High speed writing of characters from a moving frame of reference, the carriage, is then accomplished by summing, with at least one of the writing servocontrol voltages, a compensating voltage which represents displacement across a character position. Thus, compensation for the moving frame of reference is achieved essentially independently of carriage speed.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

I claim:

1. In a calligraphic character printer of the type in which a carriage transports a stylus assembly, including a pair of stylus controlling transducers, along a line of print, a slaved ramp system for writing while the carriage is moving, said system comprising:

means for driving said carriage at a selectable speed and for synchronously generating pulse signals at a rate which is proportional to carriage speed;

a digital counter which is incremented by said pulse signals; means for resetting said counter at the start of writing each character;

a digital to analog converter interconnected with said counter to provide a voltage which varies in proportion to displacement of said carriage;

means for generating, from stored data, a pair of voltages which represent stylus position components along transverse directions relative to a fixed frame of reference;

means for summing the carriage displacement voltage with at least one of said position component voltages thereby to obtain respective control voltages for said transducers;

means for driving said transducers to effect stylus movement which is, relative to the carriage, proportional to said control voltages and which is, relative to the platen, proportional to the position voltages essentially independent of the velocity of the carriage.

2. A system as set forth in claim 1 wherein said carriage driving means comprises a motor and an encoder for generating said pulse signals.

3. In a calligraphic character printer of the type in which a carriage transports a stylus assembly, including a pair of stylus controlling transducers, along a line of print, a slaved ramp system for writing while the carriage is moving, said system comprising:

means for driving said carriage at a selectable speed and for synchronously generating a pulse signal each time said carriage moves a predetermined increment of distance;

a digital counter which is advanced by said pulses;

a digital to analog converter interconnected with said counter to provide a voltage which varies in proportion to displacement of said carriage;

means for generating, from stored data, a pair of voltages which represent stylus velocity components along transverse directions relative to a fixed frame of reference;

a pair of integrators for generating, from said velocity voltages, respective relative position voltages;

means for resetting said counter at the start of writing each character and for simultaneously resetting said integrators;

means for summing the carriage displacement voltage with at least one of said relative position voltages thereby to obtain respective control voltages for said transducers representative of position with respect to said platen;

means for driving said transducers to effect stylus movement which is, relative to the carriage, proportional to said control voltages and which is, relative to the platen, proportional to the relative position voltages essentially independent of the velocity of the carriage.

4. A system as set forth in claim 3 wherein said carriage driving means comprises a motor and an encoder for generating said pulse signals.

5. In a character printer in which each of a series of successive characters is represented by a plurality of digital data words, a character drawing mechanism which comprises:

a platen;

a carriage traversable across said platen;

a stylus;

carried on said carriage, a pair of linear transducers for moving said stylus in essentially transverse directions thereby permitting positioning of said stylus within a predetermined region relative the carriage, one of said transverse directions being essentially parallel to the direction of carriage movement, each of said transducers including means providng a feedback signal;

means for driving said carriage at a selectable speed and for synchronously generating pulse signals at a rate which is proportional to carriage speed;

a digital counter which is advanced by said pulse signals;

a digital to analog converter interconnected with said counter to provide a voltage which varies in proportion to displacement of said carriage;

means for generating, from said data words, a pair of voltages which represent velocity components along the said transverse directions;

a pair of integrators for generating, from said velocity voltages, respective relative position voltages;

means for combining the carriage displacement voltage with the relative position voltage corresponding to the transducer which parallels carriage movement and with the respective feedback signal thereby to obtain a respective control voltage representative of position with respect to said platen;

means for combining the position and feedback signals corresponding to the transverse transducer thereby to obtain a respective control voltage;

means for resetting said counter voltage and both of said integrators at the start of drawing of each character;

means for driving each said transducers in response to the respective control voltage to effect stylus movement which is, relative to the carriage, proportional to said control voltages and which is, relative to the platen, proportional to the relative position voltages essentially independent of the velocity of the carriage.

* * * * *